US011051593B2

(12) United States Patent
Catanese

(10) Patent No.: US 11,051,593 B2
(45) Date of Patent: Jul. 6, 2021

(54) ADJUSTABLE BRACELET CLASP

(71) Applicant: Omega SA, Bienne (CH)

(72) Inventor: Rocco Catanese, Bienne (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 16/702,161

(22) Filed: Dec. 3, 2019

(65) Prior Publication Data

US 2020/0187604 A1 Jun. 18, 2020

(30) Foreign Application Priority Data

Dec. 13, 2018 (EP) ..... 18212450

(51) Int. Cl.
*A44C 5/20* (2006.01)

(52) U.S. Cl.
CPC ..... *A44C 5/2057* (2013.01)

(58) Field of Classification Search
CPC . Y10T 24/4782; Y10T 24/2155; A44C 5/246; A44C 5/2057
See application file for complete search history.

(56) References Cited

U.S. PATENT DOCUMENTS

| | | | | |
|---|---|---|---|---|
| 5,787,554 | A * | 8/1998 | Hashimoto | A44C 5/185 24/265 WS |
| 6,944,916 | B2 * | 9/2005 | Kawagoe | A44C 5/185 24/265 WS |
| 9,314,073 | B2 * | 4/2016 | Kaltenrieder | A44C 5/246 |
| 2009/0089980 | A1 | 4/2009 | Journe et al. | |

FOREIGN PATENT DOCUMENTS

| | | | |
|---|---|---|---|
| CH | 702 523 | A2 | 7/2011 |
| EP | 2 868 222 | A1 | 5/2015 |
| EP | 3 170 420 | A1 | 5/2017 |
| JP | S49-31630 | U | 3/1974 |
| JP | H01-126908 | A | 5/1989 |
| JP | 2009-525789 | A | 7/2009 |

OTHER PUBLICATIONS

Machine english translation of EP 3170420A1, retreived from Espaceneton Nov. 24, 2020. (Year: 2020).*
Machine english translation of EP 2868222A1, retreived from Espacenet on Nov. 24, 2020. (Year: 2020).*
European Search Report for EP 18 21 2450 dated Jun. 4, 2019.
Communication dated Jan. 12, 2021, from the Japanese Patent Office in Application No. 2019-221934.

* cited by examiner

*Primary Examiner* — Robert Sandy
(74) *Attorney, Agent, or Firm* — Sughrue Mion, PLLC

(57) ABSTRACT

A bracelet clasp (1) of the deployant buckle type, including first and second strips (2, 4) articulated to each other via a first of their respective ends, between a closed position for wear, and at least one open position, the first strip (2) carrying a member (20) for attaching a first bracelet strand, the second, lower strip (4) having a loop member (28) at its second end defining a passage for a second bracelet strand and carrying a stud (30) intended to be inserted into a suitable hole in the bracelet strand to define an anchoring point of the latter to the clasp (1), the clasp (1) further including at least one locking member (11) for holding the first and second strips (2, 4) in their closed position, characterized in that the stud (30) is movable with respect to the loop member (28) and includes an actuator (34) arranged to move it and thereby define at least two predefined positions associated with a predefined useful bracelet length.

15 Claims, 3 Drawing Sheets

ADJUSTABLE BRACELET CLASP

CROSS REFERENCE TO RELATED APPLICATIONS

This application claims priority to European Patent Application No. 18212450.3 filed on Dec. 13, 2018, the entire contents of which are incorporated herein by reference.

FIELD OF THE INVENTION

The present invention concerns a bracelet clasp, of the deployant buckle type, having first and second strips articulated to each other, by a first of their respective ends, between a closed position for wear, and at least one open position, the first strip carrying a member for attaching a first bracelet strand, the second, lower, strip comprising a loop member at its second end defining a passage for a second bracelet strand, and carrying a stud intended to be inserted into a suitable hole in the bracelet strand to define an anchoring point of the latter to the clasp, the clasp further comprising at least one locking member for holding the first and second strips in their closed position.

The present invention also concerns a wristwatch provided with such a clasp.

STATE OF THE ART

The problem of the need to provide a device for adjusting the useful length of a bracelet is well known.

On the one hand, in the case of bracelets formed of links, it is possible that the circumference of the user's wrist has a value that lies between two configurations of the bracelet differing from each other by a single link. Thus, it is useful to provide a device for adjusting the useful length of the bracelet that allows a finer adjustment of the bracelet length than the removal or addition of a link.

Further, it is also known that the value of the wrist circumference varies with season, a maximum value generally being reached in summer and a minimum value being reached in winter. Here too, it is preferable to provide a device for fine adjustment of the useful length of the bracelet that allows the wearer of the bracelet to adjust the length to improve the wear comfort of the bracelet.

By way of example, EP Patent Application No. 09131060A1 discloses a clasp with a deployant buckle having a cover with a series of pairs of holes intended to accommodate the ends of a bracelet attachment bar. Two adjacent pairs of holes are separated by a distance defining an adjustment step of the useful bracelet length, to answer the aforementioned problems.

However, this type of bracelet length adjustment device is unattractive given that the adjustment holes are visible on the sides of the cover. Further, the operation to adjust this type of clasp requires some dexterity since it requires inserting a pointed tool into the holes to compress the bracelet attachment bar, which risks causing damage to the cover in case of clumsiness by the person performing the adjustment.

To avoid this situation, alternative devices have already been disclosed, such as for example in EP Patent No 0350785 B1 which discloses a clasp similar to the above but comprising, alternatively, a device for adjusting the useful length of the bracelet that can be operated without using a tool. Indeed, the clasp disclosed in this patent is of the deployant buckle type having two strips articulated to each other by means of a pin that passes through both, each of the strips carrying at its free end a member for attachment to a bracelet. A first strip bears a hook intended to be engaged in a hole arranged in the second strip to cooperate therein with a spring catch that enables the hook, and thus the clasp, to be locked in a closed state. The second strip comprises two parts able to slide in relation to one another within a certain predefined range, defining an adjustment step of the useful length of the bracelet. A first of these two parts bears the hinge connecting it to the first strip, while the second part bears the locking spring catch. The hole in which the hook engages to lock the clasp has a length, in the longitudinal direction of the bracelet, corresponding to the sliding range between the two parts of the second strip. The spring catch has a central part defining two positions for the hook in the longitudinal direction of the bracelet that correspond to two different useful lengths of the bracelet. A control member including, in particular, a pusher, can actuate the spring catch to release the hook and open the clasp.

It should be noted that one drawback which results from this structure is the loss of the bracelet length adjustment each time that the clasp is opened. Consequently, each time the clasp is closed, the wearer of the bracelet must ensure that the hook is inserted on the side of the central portion of the spring catch corresponding to the desired bracelet length.

Adjustment devices comprising a specific locking member have also been proposed, by way of alternative, to avoid this type of drawback.

SUMMARY OF THE INVENTION

It is a main object of the present invention to overcome the drawbacks of known prior art clasps, by proposing a bracelet clasp comprising a device for adjusting the useful length of a bracelet which has a simple structure, preferably offering stable adjustment, including when the clasp is open, and which is easy to operate.

To this end, the present invention more particularly concerns a bracelet clasp, of the deployant buckle type, comprising first and second strips articulated to each other by a first of their respective ends between a closed position for wear, and at least one open position, said first strip carrying a member for attaching a first bracelet strand, said second, lower strip carrying at its second end means for adjusting the length of the bracelet, the clasp further comprising at least one locking member for holding said first and second strips in their closed position.

According to the invention, said length adjustment means comprise a bar movable in translation relative to the second strip and carrying a stud intended to be inserted into a suitable hole in the bracelet strand to define an anchoring point of the latter to the clasp, the movable bar being able to be moved by means of two pushers mounted on the second strip and thereby to define at least two positions associated with a useful length of the bracelet.

Generally speaking, each of the positions can advantageously be defined by a hole arranged in the loop member and in which the stud can be partially engaged.

In accordance with other advantageous variants of the invention:

- said stud has a base integral therewith, said base being arranged to move in a housing in the loop member;
- the loop member has an oblong recess, said stud passing through said recess;
- the loop member has a cover arranged to cooperate with the base of the stud, the stud and the base comprising complementary guide means;

the complementary guide means comprise, on the one hand, lateral wings integral with the stud, and on the other hand, guide grooves formed in said cover, the grooves being arranged to guide the lateral wings;

said guide grooves comprise hollows defining distinct positions of the stud;

the actuation means comprise a spring click disposed inside a housing of the stud;

the cover is slidably mounted on the loop member, the cover being held in placed on the loop member by a screw;

the housing formed in the loop member includes at least one stop member for holding the stud in place.

The invention also concerns a wristwatch including a bracelet or wristband provided with a clasp according to the invention.

BRIEF DESCRIPTION OF THE DRAWINGS

Other features and advantages of the present invention will appear more clearly upon reading the following detailed description of a preferred embodiment, made with reference to the annexed drawings, given by way of non-limiting example and in which.

EMBODIMENT(S) OF THE INVENTION

The clasp illustrated in a non-limiting manner in the Figures is a preferred embodiment of the present invention. More specifically, clasp 1 is of the deployant buckle type and is intended to close a timepiece bracelet or strap.

Figure 1:
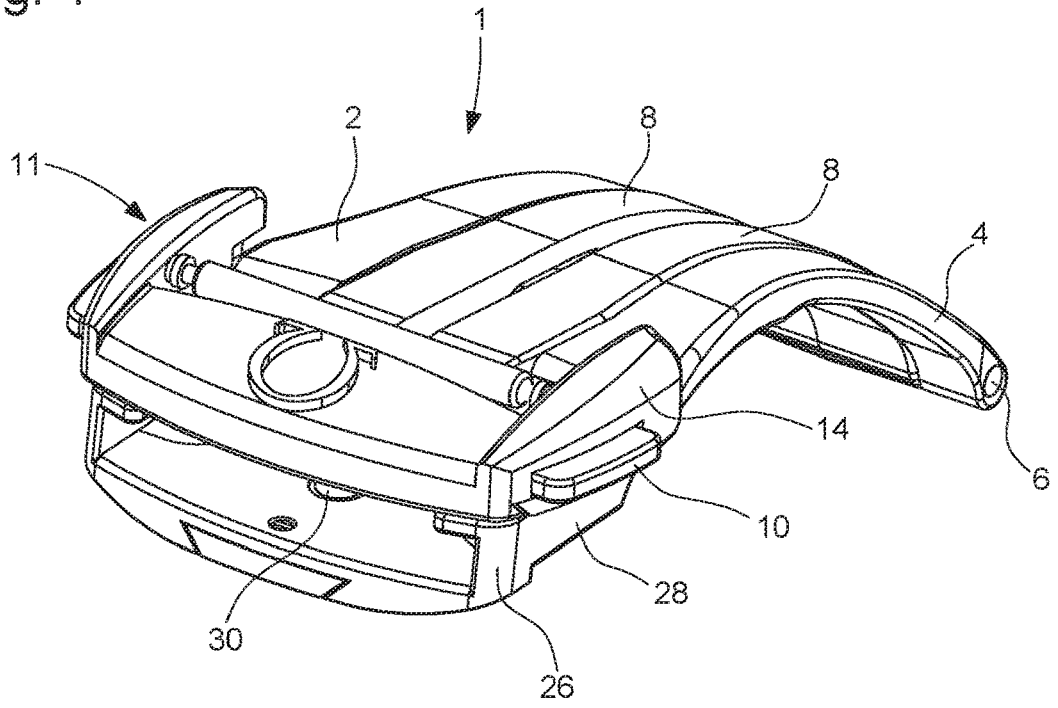
FIG. 1 represents a perspective view of a clasp according to the invention.
Figure 2:
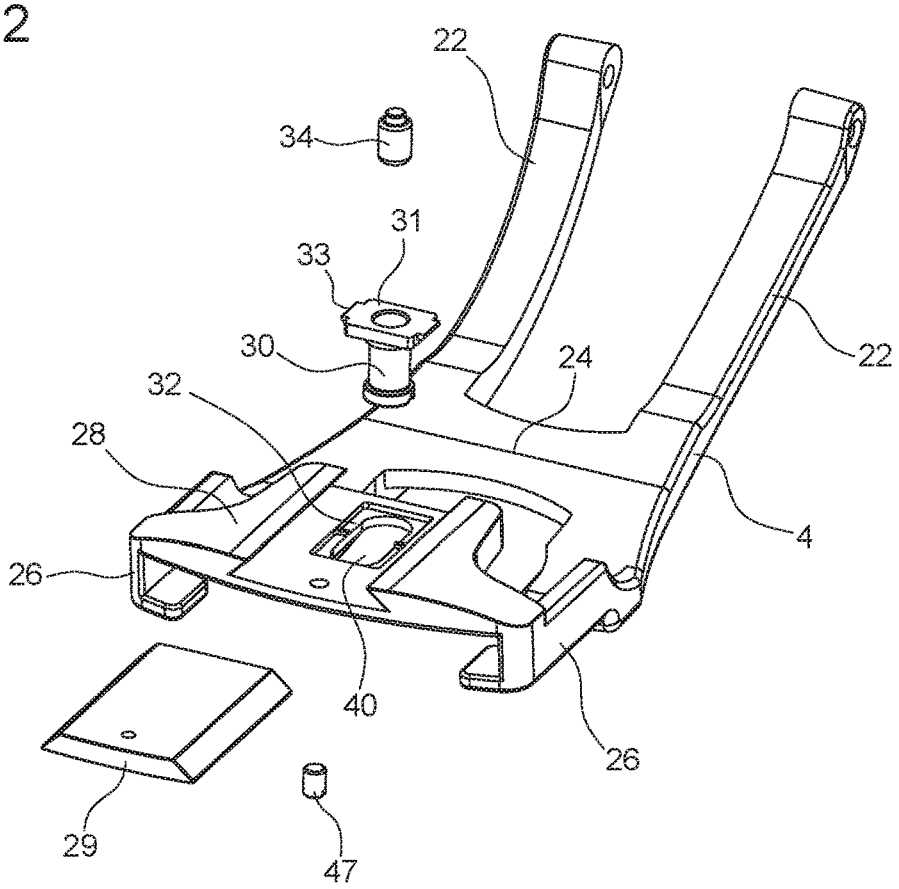
FIG. 2 represents a bottom perspective view of a clasp according to the invention.

As seen more particularly in FIGS. 1 and 2, clasp 1 includes a first strip 2 articulated on a second strip 4 by means of a pin 6, in a non-limiting illustrative manner. Each of the strips has an elongated shape in the longitudinal direction of the bracelet and is slightly curved to better match the shape of the wearer's wrist.

First strip 2 includes two side members 8 arranged in contact with each other at the end thereof located close to pin 6, and each having a cut out portion so that said side members are not in contact with each other over most of their length.

Each of side members 8 carries an extension portion 10, in proximity to its end farthest from pin 6, extending in a direction perpendicular to the longitudinal direction of the bracelet, to form a pusher defining a control member for unlocking the clasp, as shown in FIG. 3.

Further, the free end of first strip 2 carries means 11 for holding the bracelet intended to be joined to clasp 1.

The holding means include a cap 12 having an upper wall 13 carrying lateral walls 14. The lateral walls 14 are provided with two holes for housing one end of a bar 20 securing a bracelet strand, in a conventional manner.

The second strip 4 includes two arms 22 connected by a cross member 24 in their central area. Arms 22 are extended by bent portions 26 carrying a loop member 28 of a bracelet strand, shifted relative to the general direction of arms 22 to define a recess for the bracelet strand.

Loop member 28 has a movable stud 30 intended to be engaged in a hole in the bracelet to define an anchoring point of the latter to clasp 1. Thus, movable stud 30 makes it possible to change the position of the anchoring point of the bracelet on the clasp and thus the length of the bracelet for wear.

Advantageously, loop member 28 arranged at the free end of second strip 4 carries a device for adjusting the useful length of the bracelet intended to be joined to clasp 1.

The device for adjusting the useful length of the bracelet includes, in particular, stud 30, which is provided with a base 31 of rectangular shape integral with stud 30, and which is arranged to move in loop member 28. Base 31 is able to slide inside a rectangular housing 32 provided on the bottom of loop member 28. Stud 30 and base 31 can be made in one or two parts depending upon the manufacturer's requirements.

According to the invention, loop member 28 includes an oblong recess 40 formed on the top of loop member 28, oblong recess 40 opening onto housing 32. Thus, stud 30 passes through the recess when it is mounted on the loop member, base 31 being housing inside rectangular housing 32.

As illustrated in FIG. 2, loop member 28 has a cover 29 arranged to cover housing 32 once stud 30 and base 31 are in place. Cover 29 is inserted by being made to slide into the loop member at its free end, cover 29 having a shape complementary to the shape of hole 41 machined in loop member 28 for receiving cover 29. To this end, cover 29 has a trapezoidal cross-section, each of the edges (or lateral walls) cooperating with corresponding inclined grooves formed in loop member 28, the connection between cover 29 and loop member 28 forming a dovetail assembly. Cover 29 can be joined to loop member 28 by means of a screw 47 or any other means allowing cover 29 to be removed once the latter is in place on the loop member.

Figure 5A:
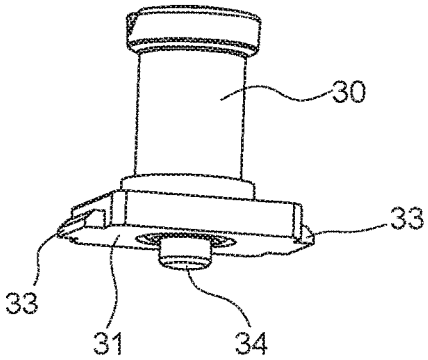
FIGS. 5*a* to 5*c* illustrate the means for adjusting the useful length of the bracelet comprised in a clasp according to the invention.
Figure 5B:
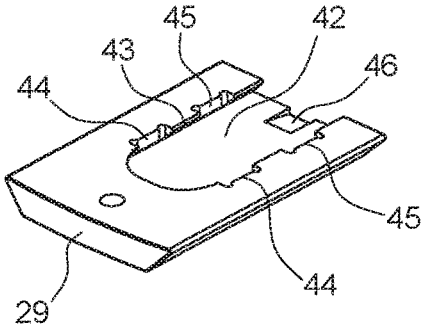

As can be observed in FIG. 5*b*, cover 29 also includes a recess 42 formed on its inner face, namely the face in contact with loop member 28, recess 42 being arranged to be positioned facing housing 32 of the loop member once cover 29 is assembled. Housing 32 and recess 42 thus define a space inside which base 31 of stud 30 can move between at least two positions in order to adjust the useful length of the bracelet.

Advantageously, recess 42 includes two lateral guide grooves 43, arranged to cooperate with base 31 of stud 30, and more particularly with lateral wings 33 arranged on the edges of said base 30. Guide grooves 43 each have at least two cut out portions 44 and 45 arranged opposite each other to form the various possible positions of stud 30, lateral wings 32 being housed inside cut out portions 44 or 45 once stud 30 has moved.

Guide grooves 43 and lateral wings 33 offer a dovetail guiding arrangement similar to that of cover 29 in loop member 28. Those skilled in the art will not have any particular difficulty in making another more conventional type of guiding arrangement; straight grooves could also be used for guiding. This dovetail guiding arrangement has the advantage of being more solid and less visible, of reducing play between the components and thus of being more precise, it also facilitates assembly once cover 29 has slid into housing 41 and ensures that screw 47 is not under stress or strain except for the assembly between the cover and the loop member.

Figure 3A:
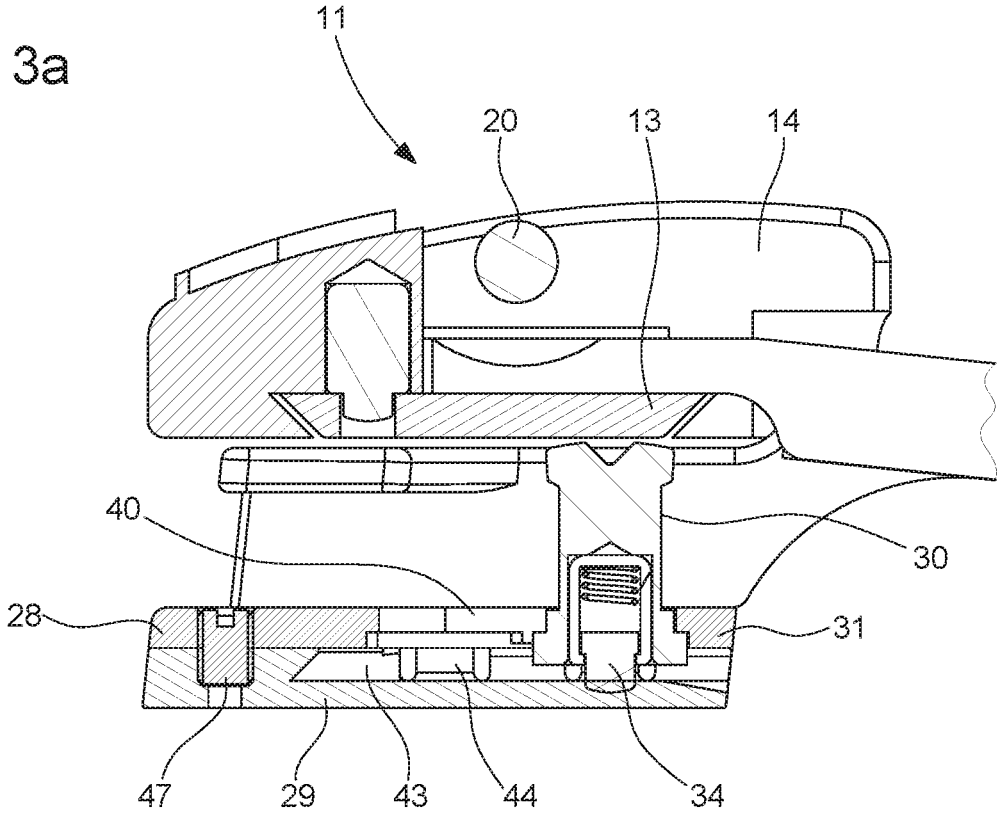
FIGS. 3*a* and 3*b* represent a sectional view of a clasp according to the invention, respectively in a short position and a long position.
Figure 3B:
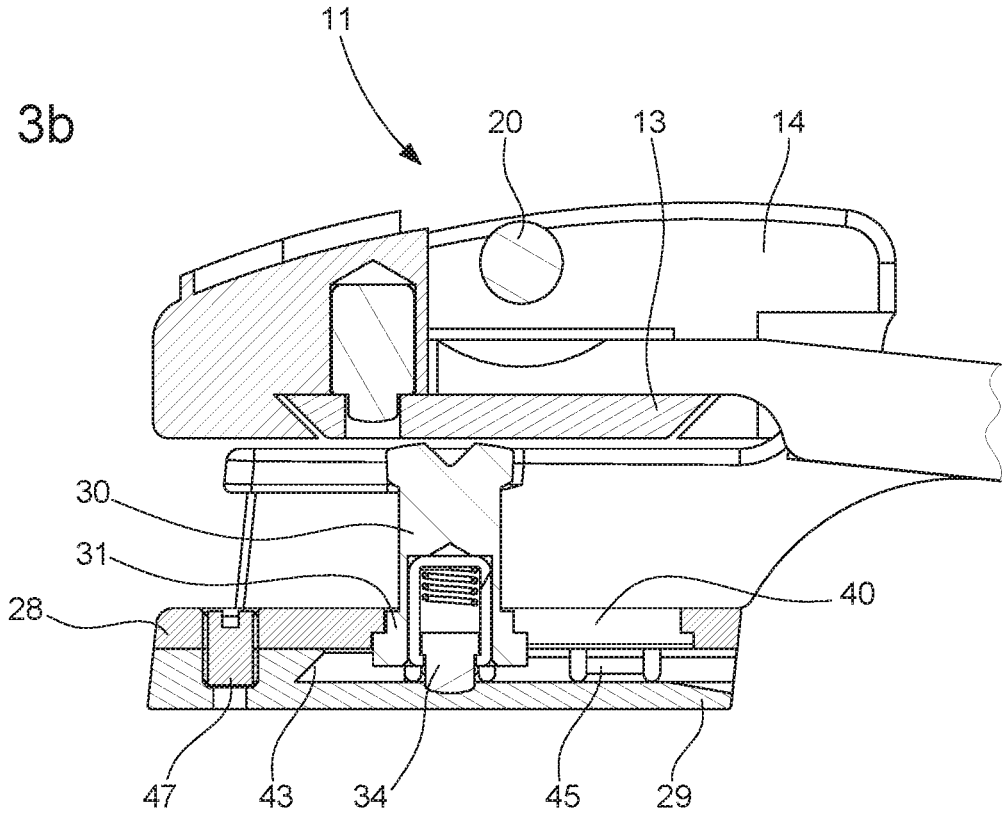
Figure 4A:
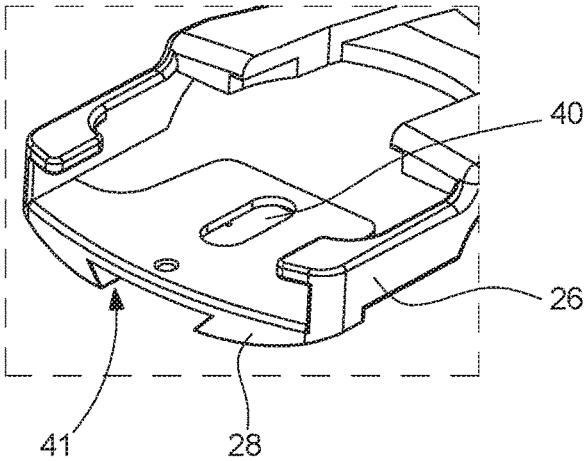
FIGS. 4*a* and 4*b* represent a top and bottom perspective view of the loop member of a clasp according to the invention.
Figure 4B:
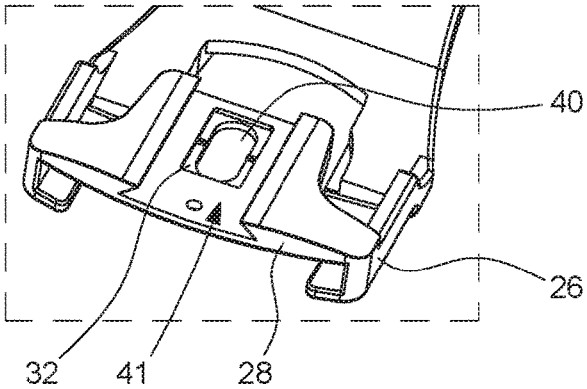

As can be observed in FIGS. 2, 3*a* and 3*b*, stud 30 includes a spring click 34 arranged in a housing formed in the body of stud 30. The click is arranged to be positioned such that the head slightly protrudes from base 31 through an orifice formed in the latter. Spring click 34 is arranged to be in contact with the bottom of recess 42 and retracts into the body of stud 30 when the wearer presses thereon to move stud 30 from one position to another.

Figure 5C:
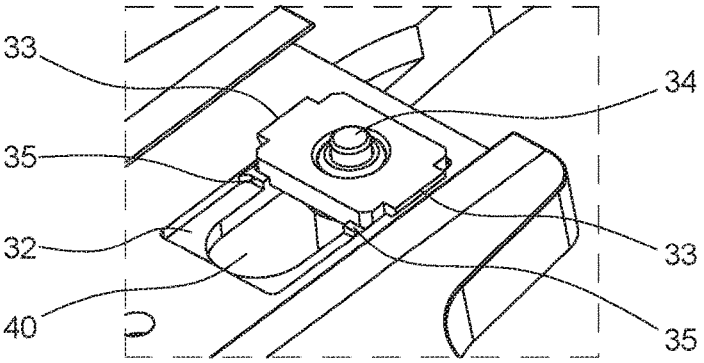

As can be observed in FIG. 5*c*, housing 32 has stop members 35 to remove any clearance of base 31 of stud 30 once the latter is mounted and held by cover 29.

Thus, when the wearer wishes to change the bracelet length, the wearer can change the position of stud 30 by pressing thereon to dislodge the lateral wings of base 31 from cutout portions 44 formed in guide grooves 43, and then sliding it towards a second position in which lateral wings 33 are facing cutout portions 45. Once the position is selected, the wearer releases stud 30 and the position is locked when the stud moves up again and wings 33 are housed in cutout portions 45.

The assembly of cover 29 on loop member 28 when stud 30 is in place inside housing 32 is facilitated by a notch 46 having a slope arranged at the entry to recess 42. In this manner, when cover 29 is inserted and then slid into machined hole 41, the slope of notch 46 guides spring click 34 without locking it.

Further, conventional locking means are provided in order to keep the clasp in the closed state. To this end, a conventional locking mechanism is arranged to keep first strip 2 locked on second strip 1 when there is no pressure simultaneously exerted on the pushers formed by extension portions 10. Extension portions 10 each have fixed hooks configured to cooperate respectively with hooks disposed on arms 22 of second strip 4.

When extension portions 10 are actuated, the hooks move away from each other to move the clasp into its open state.

EP Patent Application No 09131060 A1 discloses in detail a clasp of this type and those skilled in the art may refer thereto if required.

The space between arms 22 of second strip 4 defines a recess for accommodating first strip 2 in the closed state of clasp 1 in a known manner.

Clasp 1 is shown in its long configuration in FIG. 3*a*. If the stud is moved towards the left of the Figure, the bracelet (not represented) is thus shortened and occupies the position represented in FIG. 3*b*.

It is apparent from the present disclosure that the clasp according to the present invention includes a stud able to be moved to adjust the useful length of the bracelet. The design and operation of this stud are simple and enable the user to easily adjust the clasp when necessary.

The above description endeavours to describe a particular embodiment by way of non-limiting illustration and the invention is not limited to the implementation of certain particular features that have just been described such as, for example, the specifically illustrated shapes described for the strips or their mode of cooperation for locking the clasp.

Those skilled in the art will not encounter any particular difficulty in adapting the content of the present disclosure to their own requirements and in implementing a clasp, in particular for a timepiece, without departing from the scope of the invention. It will be noted, for example, that adapting the teaching herein to the design of a deployant buckle with a different structure from that illustrated and described here will not cause any particular difficulty for those skilled in the art.

Further, the clasp according to the present invention is not limited to the implementation of two positions for the stud, or even to two positions for adjusting the useful length of the bracelet. Indeed, those skilled in the art will not encounter any particular difficulty either in adapting the teaching herein to the implementation of a clasp having a greater number of possible adjustment positions.

The invention claimed is:

1. A bracelet clasp (1), of a deployant buckle type, comprising:

a first strip (2) and a second strip (4) articulated to each other, by a first of their respective ends, such as to be configured to move between a closed position for wear and at least one open position, wherein said first strip (2) carries a member (20) that is configured to attach a first bracelet strand, said second strip (4) comprises a loop member (28) at its second end defining a passage for a second bracelet strand, and carrying a stud (30) intended to be inserted into a suitable hole in the second bracelet strand to define an anchoring point thereof to the bracelet clasp (1), the bracelet clasp (1) further comprising at least one locking member (11) that is configured to hold said first strip (2) and said second strip (4) in their closed position, said stud (30) is movable with respect to the loop member (28) and includes actuation means (34) that is configured to be actuated such that the stud (30) is able to move between at least two predefined positions associated with a predefined useful bracelet length, said stud (30) includes a base (31) integral therewith, said base (31) being arranged to move in a housing (32) of the loop member (28), and the loop member (28) includes an oblong recess (40), said stud (30) passing through said oblong recess (40) and the base (31) coming into contact with the oblong recess (32).

2. The bracelet clasp (1) according to claim 1, characterized in that the housing (32) formed in the loop member (28) includes at least one stop member (35) for holding the stud (30) in place.

3. A wristwatch including a bracelet provided with the bracelet clasp (1) according to claim 1.

4. A bracelet clasp (1), of a deployant buckle type, comprising:

a first strip (2) and a second strip (4) articulated to each other, by a first of their respective ends, such as to be configured to move between a closed position for wear and at least one open position, wherein said first strip (2) carries a member (20) that is configured to attach a first bracelet strand, said second strip (4) comprises a loop member (28) at its second end defining a passage for a second bracelet strand, and carrying a stud (30) intended to be inserted into a suitable hole in the second bracelet strand to define an anchoring point thereof to the bracelet clasp (1), the bracelet clasp (1) further comprising at least one locking member (11) that is configured to hold said first strip (2) and said second strip (4) in their closed position, said stud (30) is movable with respect to the loop member (28) and includes actuation means (34) that is configured to be actuated such that the stud (30) is able to move between at least two predefined positions associated with a predefined useful bracelet length, said stud (30) includes a base (31) integral therewith, said base (31) being arranged to move in a housing (32) of the loop member (28), and the loop member (28) includes a cover arranged to cover the housing (32) and to cooperate with the base (31) of the stud (30), the stud and the base each comprising complementary guide means.

5. The bracelet clasp (1) according to claim 4, characterized in that the cover (29) includes a recess (42) arranged to be placed facing the housing (32) such as to form a space in which the base (31) of the stud (30) moves.

6. The bracelet clasp (1) according to claim 5, characterized in that the complementary guide means include lateral wings (33) integral with the stud (30) and guide grooves (43) formed in the recess (42) of said cover (29), the guide grooves configured to guide the lateral wings.

7. The bracelet clasp (1) according to claim 6, characterized in that said guide grooves (43) comprise cutout portions (44, 45) defining distinct positions of the stud (30).

8. The bracelet clasp (1) according to claim 4, characterized in that the complementary guide means include lateral wings (33) integral with the stud (30) and guide grooves (43) formed in a recess (42) of said cover (29), the guide grooves configured to guide the lateral wings.

9. The bracelet clasp (1) according to claim 8, characterized in that said guide grooves (43) comprise cutout portions (44, 45) defining distinct positions of the stud (30).

10. The bracelet clasp (1) according to claim 4, characterized in that the cover (29) is slidably mounted on the loop member (28), the cover being held in place on the loop member in a machined hole (41) therein by a screw (47).

11. The bracelet clasp (1) according to claim 4, characterized in that the housing (32) formed in the loop member (28) includes at least one stop member (35) for holding the stud (30) in place.

12. A wristwatch including a bracelet provided with the bracelet clasp (1) according to claim 4.

13. A bracelet clasp (1), of a deployant buckle type, comprising:

a first strip (2) and a second strip (4) articulated to each other, by a first of their respective ends, such as to be configured to move between a closed position for wear and at least one open position, wherein said first strip (2) carries a member (20) that is configured to attach a first bracelet strand, said second strip (4) comprises a loop member (28) at its second end defining a passage for a second bracelet strand, and carrying a stud (30) intended to be inserted into a suitable hole in the second bracelet strand to define an anchoring point thereof to the bracelet clasp (1), the bracelet clasp (1) further comprising at least one locking member (11) that is configured to hold said first strip (2) and said second strip (4) in their closed position, said stud (30) is movable with respect to the loop member (28) and includes actuation means (34) that is configured to be actuated such that the stud (30) is able to move between at least two predefined positions associated with a predefined useful bracelet length, said stud (30) includes a base (31) integral therewith, said base (31) being arranged to move in a housing (32) of the loop member (28), and the actuation means comprises a spring click (34) disposed inside the stud (30), the spring click (34) partly protruding from the base (31).

14. The bracelet clasp (1) according to claim 13, characterized in that the housing (32) formed in the loop member (28) includes at least one stop member (35) for holding the stud (30) in place.

15. A wristwatch including a bracelet provided with the bracelet clasp (1) according to claim 13.

* * * * *